US006783321B2

(12) United States Patent
Lathrop et al.

(10) Patent No.: US 6,783,321 B2
(45) Date of Patent: Aug. 31, 2004

(54) DIFFUSING COUPLING COVER FOR AXIALLY JOINED TURBINES

(75) Inventors: Norman Douglas Lathrop, Ballston Lake, NY (US); Daniel Mark Brown, Altamont, NY (US); Edward John Sharrow, Scotia, NY (US); Kristin Segreto, Wethersfield, CT (US); Douglas Carl Hofer, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/288,301

(22) Filed: Nov. 6, 2002

(65) Prior Publication Data

US 2004/0086375 A1 May 6, 2004

(51) Int. Cl.[7] ..... F01D 1/04

(52) U.S. Cl. ..... 415/100; 415/101; 415/103; 415/199.5; 415/207; 415/208.1; 415/211.2; 416/201 R

(58) Field of Search ..... 415/100, 101, 415/103, 199.4, 199.5, 207, 208.1, 211.2; 416/198 A, 201 R

(56) References Cited

U.S. PATENT DOCUMENTS 2,919,891 A * 1/1960 Oliver ..... 415/199.5
4,432,697 A * 2/1984 Miura et al. ..... 416/198 A

FOREIGN PATENT DOCUMENTS

GB 221781 A * 8/1925 ..... 415/199.5

* cited by examiner

*Primary Examiner*—Christopher Verdier
(74) *Attorney, Agent, or Firm*—Nixon & Vanderhye P.C.

(57) ABSTRACT

The shafts of upstream and downstream turbines are interconnected by a coupling. A diffuser is provided in an intermediate cavity between the upstream and downstream turbines to recover kinetic energy, as well as minimize or eliminate windage and spinning losses resultant from exposure of the coupling to the flowpath along the turbines. A radial entry inlet provides a supplemental fluid admission into the intermediate cavity, the admission being turned axially and circumferentially for joining with the flow exiting the upstream turbine for combined flow to the downstream turbine.

13 Claims, 3 Drawing Sheets

DIFFUSING COUPLING COVER FOR AXIALLY JOINED TURBINES

BACKGROUND OF THE INVENTION

The present invention relates to turbines which are axially joined one to the other along their flowpath and particularly relates to a diffuser formed between and along the flowpath of axially joined turbines for reducing energy loss in large-scale turbulent mixing while recovering energy through diffusion of the fluid flow.

Turbines are sometimes connected by coupling their rotor shafts one to the other, as well as their flowpaths. For example, two axial steam turbines may be joined axially one to the other with the steam flow exiting the final stage of the first or upstream turbine entering the first stage of the second or downstream turbine. Typically, a cavity, which also forms part of the flowpath, is located between the turbines. With the rotating shaft and coupling exposed to the flowpath, the spinning of the shaft will entrain fluid and eject the fluid back into the flowpath. This is a phenomenon often referred to as windage loss and can create substantial energy loss through turbulent mixing in the cavity. The couplings between the shafts also present a protuberant surface to the flow along the flowpath from the one turbine to the other turbine through the cavity, causing losses due to flow separation. Other energy losses also occur in axially joined turbines. For example, the exit annulus of the upstream turbine typically has a different diameter and/or height than the entrance annulus of the downstream turbine. Since the flow cannot rapidly change direction from one annulus to the next, the flow will generally impinge upon other surfaces of the cavity, with consequent losses. Further, additional steam may be admitted to the flowpath, e.g., into the cavity, before the steam enters the downstream turbine. This intermediate steam admission creates a disturbance in the flowpath of the steam transitioning between the upstream and downstream turbines.

A prior effort to reduce losses from the rotating shaft included the provision of a generally cylindrical coupling cover overlying the cover and having an axis coincident with the axis of rotation of the turbines. While this addresses certain of the losses from the rotating shaft and coupling, it does not consider all of the loss mechanisms noted above. The cylindrical cover mitigates losses in the cavity but produces an energy loss itself and does not itself recover energy from the flowpath.

BRIEF DESCRIPTION OF THE INVENTION

In accordance with a preferred embodiment of the present invention, there is provided apparatus for transitioning the flow from the upstream turbine to the downstream turbine and accommodating with reduced mixing losses a supplemental fluid flow admission into the cavity intermediate the upstream and downstream turbines. To accomplish the foregoing, there is provided a diffuser in the flowpath between the upstream and downstream turbines. An inner diffuser wall or coupling cover defines the inner diameter of the transitioning flowpath between the upstream and downstream turbines and extends between the final stage of the upstream turbine and the initial stage of the downstream turbine. The coupling cover is preferably in the form of a frustoconical section about an axis coincident with the axis of rotation of the turbine. Thus, the coupling cover overlies the coupling joining the rotor shafts to substantially minimize or preclude windage loss and flow separation due to protuberant surfaces which would otherwise be impacted by the fluid flow of the flowpath.

The diffuser also includes an outer diffuser wall which defines in part the outer margin of the flowpath between the upstream and downstream turbines. Like the inner coupling cover, the outer diffuser wall is preferably formed of a frustoconical section about the axis and is preferably cast as part of the outer turbine shell common to both turbines. The diffuser interposed between the exit annulus and entrance annulus of the upstream and downstream turbines, respectively, guides the fluid flow (steam) as it is being diffused. The diffuser therefore provides a smooth transition between the two turbines which reduces energy loss associated with the rotating shaft and coupling and misalignment between the exit and entrance annuli of the two turbines, while simultaneously increasing energy recovery through the use of a diffuser.

Supplemental fluid flow may be admitted into the flowpath cavity through an inlet intermediate the upstream and downstream turbines. The inlet is configured to turn the flow from essentially a radial direction to a flow direction having both axial and circumferentially directed components. When the supplemental admission flow meets the flowpath from the upstream turbine, the flow velocities and directions are such as to afford reduced mixing losses.

In a preferred embodiment according to the present invention, there is provided apparatus for coupling flowpaths of axially adjacent turbines to one another, comprising first and second turbines coupled axially to one another along a flowpath with fluid flow along a first flowpath portion along the first turbine exhausting from the first turbine and into a second flowpath portion along the second turbine, the turbines having respective rotors and a coupling between the first and second rotors for coupling the turbines to one another, an inner cover extending between a final stage of the first turbine and a first stage of the second turbine and extending about and overlying the coupling between the rotors to isolate the rotor coupling from the flowpath and present a substantially smooth transition of the fluid flow from the first flowpath portion of the first turbine to the second flowpath portion of the second turbine.

In a further preferred embodiment according to the present invention, there is provided apparatus for coupling turbines to one another, comprising first and second turbines coupled axially to one another and having a flowpath with fluid flow along a first flowpath portion exhausting from the first turbine and into a second flowpath portion of the second turbine, the turbines having respective rotors and a coupling between the first and second rotors for coupling the turbines to one another, an outer wall extending between a final stage of the first turbine and a first stage of the second turbine and about and overlying the flowpath between the first and second turbines to present a substantially smooth transition of the fluid flow from the first flowpath portion of the first turbine to the second flowpath portion of the second turbine.

In a further preferred embodiment according to the present invention, there is provided apparatus for coupling flowpaths of axially adjacent turbines to one another, comprising first and second turbines coupled axially to one another along a flowpath with fluid flow along a first flowpath portion along the first turbine exhausting from the first turbine through an exit annulus and into a second flowpath portion through an entry annulus to the second turbine, the turbines having respective rotors and a coupling between the first and second rotors for coupling the turbines to one another, annular wall portions extending from adjacent the exit annulus of the first turbine and radially outwardly of the coupling between the rotors forming a diffuser for conducting the fluid flow between the exit and entrance annuli and presenting a substantially smooth transition of the fluid flow from the first flowpath portion of the first turbine to the second flowpath portion of the second turbine.

DETAILED DESCRIPTION OF THE INVENTION

Figure 1:
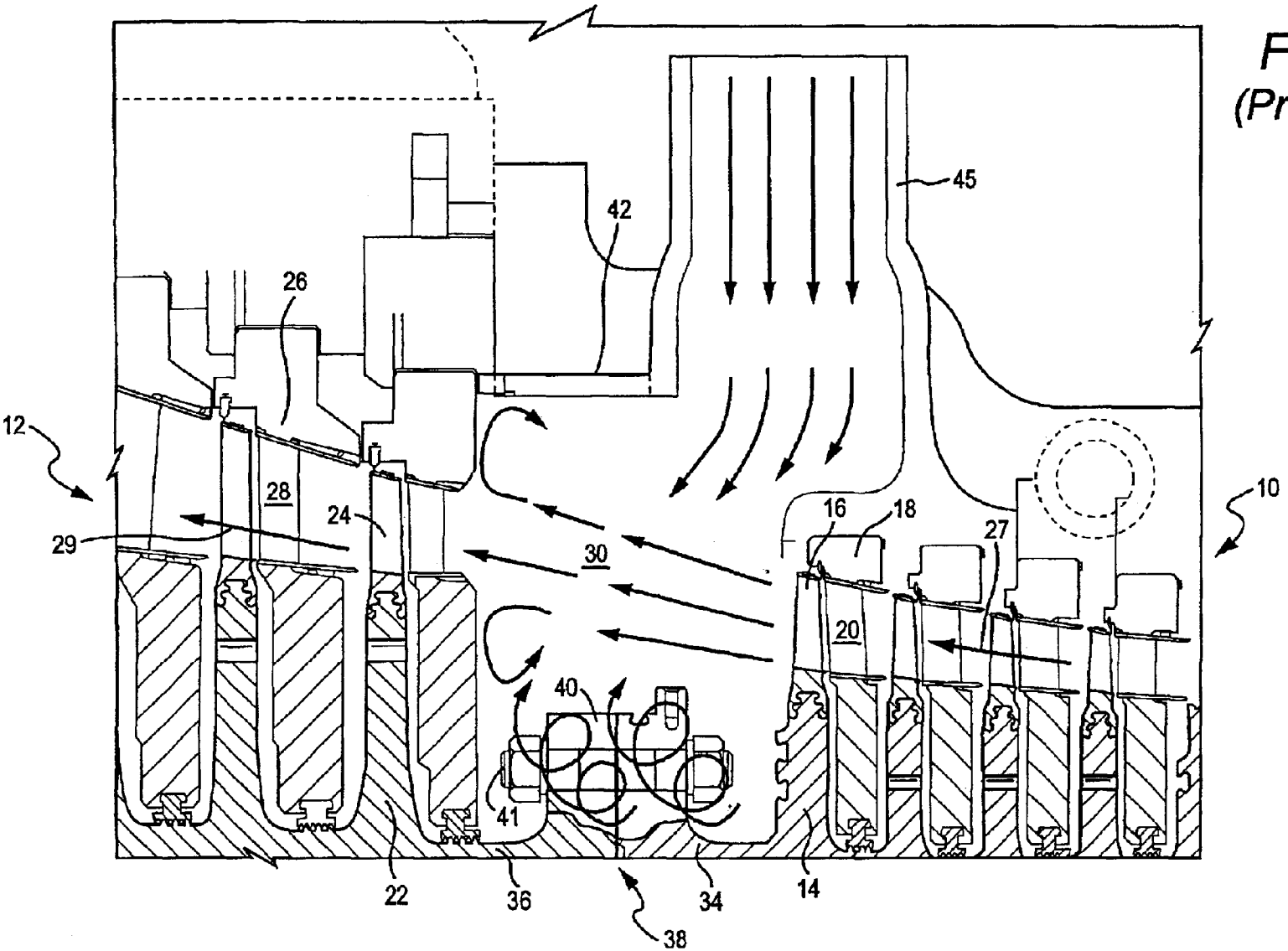
Fig. 1 (Prior Art)
FIG. 1 is a fragmentary cross-sectional view of an upper portion of a pair of turbines coupled to one another illustrating the coupling and flowpath therebetween in accordance with the prior art.

Referring to the drawing figures, particularly to FIG. 1, there is illustrated first and second turbines, namely a first or upstream turbine, generally designated 10, and a downstream turbine, generally designated 12, axially joined one to the other along their flowpaths and by coupling their rotor shafts to one another. The first turbine 10 includes a plurality of axially spaced rotor wheels 14 mounting buckets 16 which, together with diaphragms 18 mounting partitions 20, form multiple stages of the first turbine. Likewise, the second turbine 12 includes a plurality of axially spaced rotor wheels 22 mounting buckets 24 which, in conjunction with diaphragms 26 carrying partitions 28, form multiple stages of the second turbine. It will be appreciated that the energetic fluid, for example, steam, passes generally axially past the various stages of the upstream turbine 10 along a first flowpath portion indicated by the arrow 27, through an intermediate cavity 30 and through a second flowpath portion indicated by the arrow 29 comprised of the various stages of the downstream turbine 12. Thus, flowpath portions 27 and 29 and cavity 30 form a flowpath through the joined turbines. Additionally, the discrete rotor shafts 34 and 36 of the first and second turbines 10 and 12, respectively, are joined one to the other by a coupling, generally indicated 38. The coupling includes flanges 40 on the ends of the respective rotor shafts with bolts 41 interconnecting the flanges and, hence, the shafts to one another. Additionally, a pair of radial fluid (steam) admission ports 45 (only one being illustrated) are provided through a common outer shell 42 for admitting additional fluid (steam) into the intermediate cavity 30 to join the fluid in the flowpath.

As noted above, the rotating shafts 34 and 36 and the coupling 38 are exposed to the flowpath within cavity 30, with resulting windage loss through turbulent mixing and losses due to flow separation by impact against protuberant surfaces on the coupling 38 and other parts.

Figure 2:
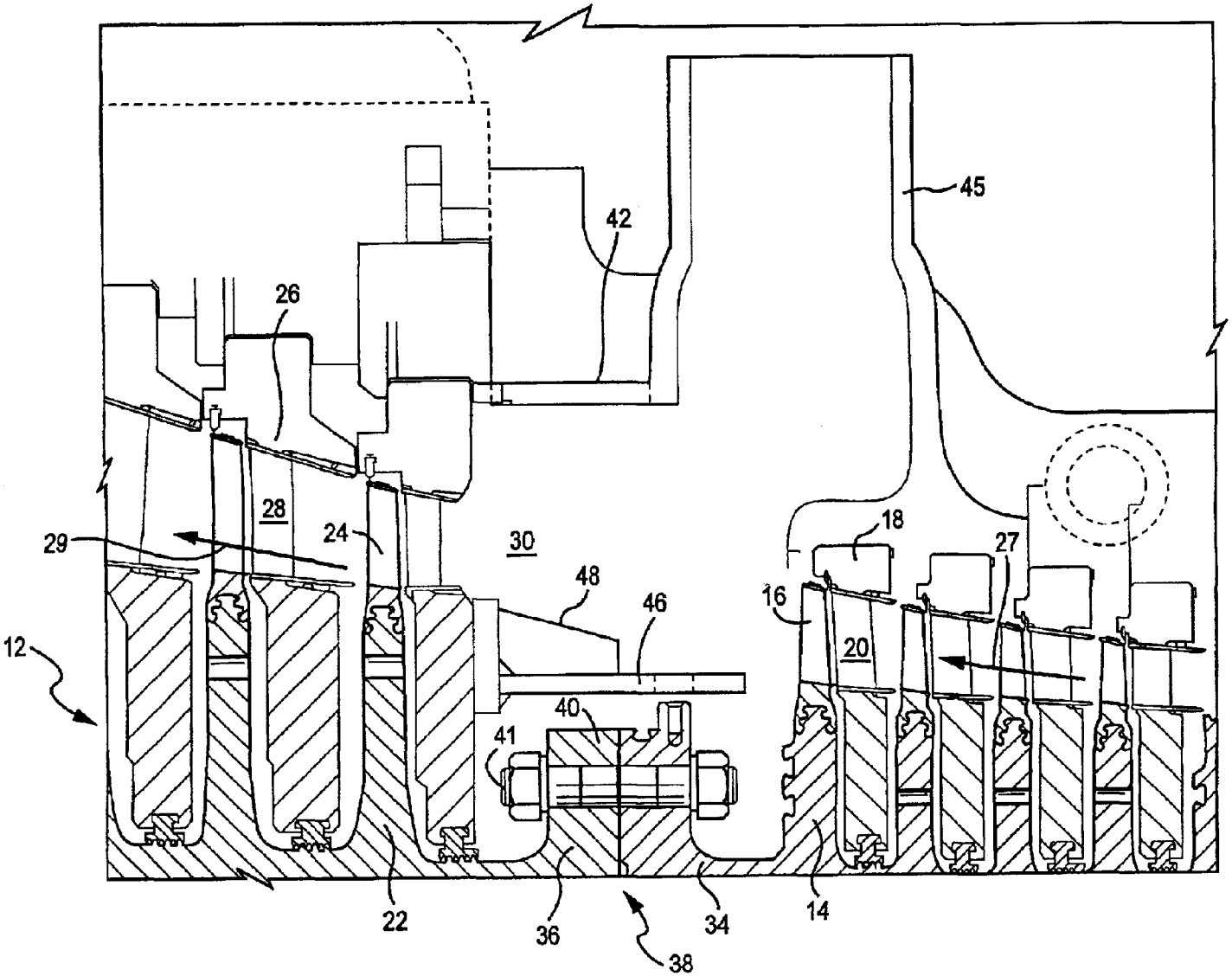
Fig. 2 (Prior Art)
FIG. 2 is a view similar to FIG. 1 illustrating a prior art coupling cover.

A prior art effort to reduce those losses is illustrated in FIG. 2. In FIG. 2, a cylindrical cover 46 having an axis coincident with the axis of rotation of the rotor shafts 34 and 36 directly overlies the coupling 38. The cover 46 has radially projecting stiffening ribs 48 about its outer surface. While spinning shaft and coupling losses have been mitigated to some extent by this arrangement, the losses remain substantial and the cylindrical cover does not address other losses along the flowpath.

Figure 3:
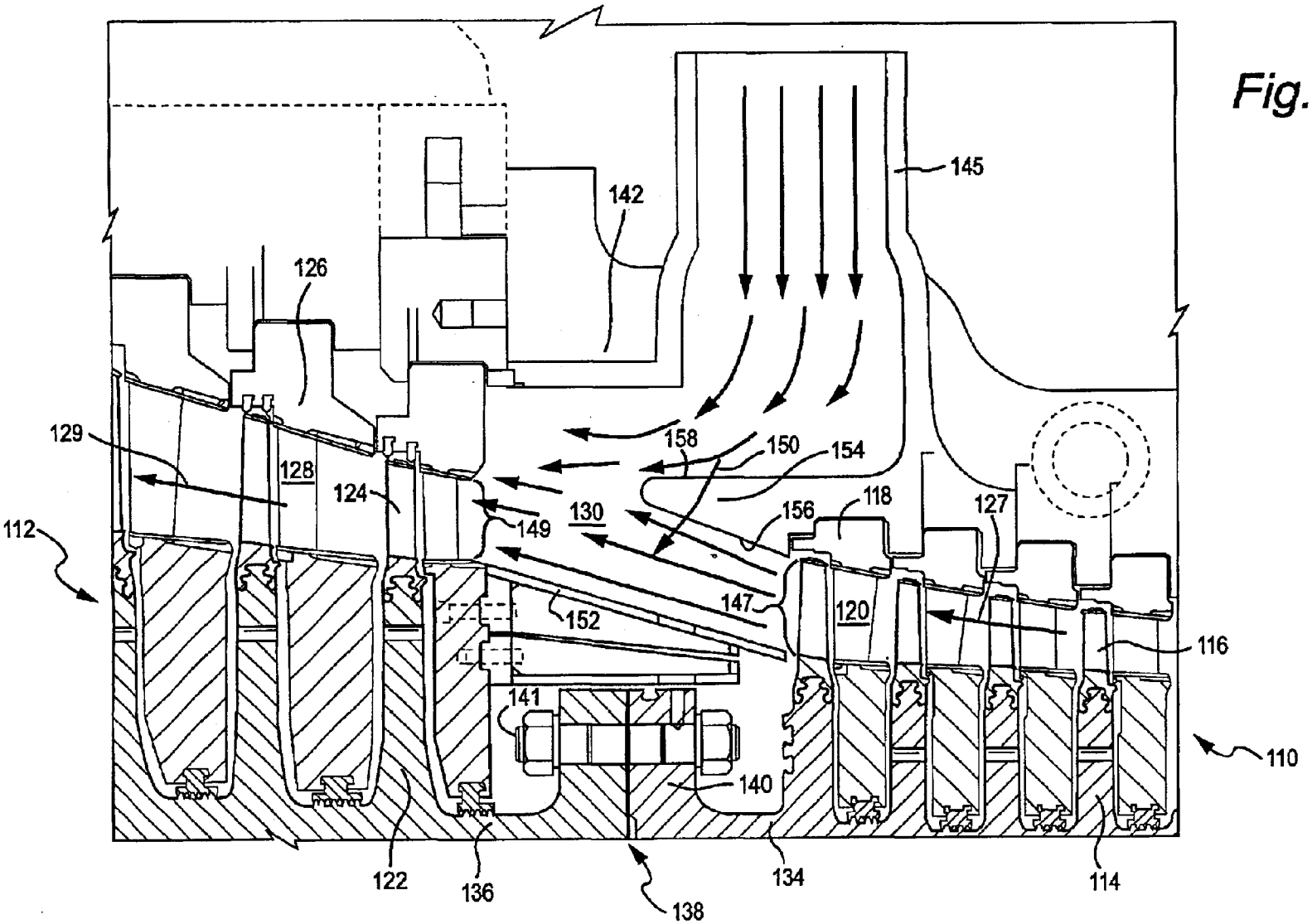
FIG. 3 is a view similar to FIG. 1 illustrating a coupling cover according to a preferred embodiment of the present invention.

Referring now to FIG. 3 illustrating a preferred embodiment of the present invention and wherein like parts as in FIGS. 1 and 2 are denoted by like reference numerals preceded by the numeral 1, there is illustrated an upstream turbine 110 having axially spaced rotor wheels 114 mounting buckets 116 which, in conjunction with diaphragms 118 carrying partitions 120, form discrete axially spaced turbine stages. Wheels 114 form part of the rotor shaft 134. Similarly, the second or downstream turbine 112 includes rotor wheels 122 mounting buckets 124 which, in conjunction with diaphragms 126 mounting partitions 128, form discrete axially spaced turbine stages. The rotor wheels 122 are mounted on the second rotor shaft 136. The first and second turbines 110 and 112 have flowpath portions 127 and 129, respectively, forming with the cavity 130 a flowpath through the turbine.

The rotor shafts 134 and 136 are joined one to the other by a coupling 138, similarly as in the prior art, using flanges 140 and a series of circumferentially spaced bolts 141 securing the flanges to one another. Also as in the prior art, a common outer shell 142 mounts one, and preferably a pair, of radial fluid or steam inlets 145 for admitting fluid (steam) into the intermediate cavity 130 for joining with the fluid (steam) exiting the exit annulus 147 of the upstream turbine 110 and flowing to the entrance annulus 149 of the downstream turbine 112. The cavity 130 extends generally axially a distance in excess of the distance between adjacent stages of the two turbines.

In accordance with a preferred embodiment of the present invention, there is provided a diffuser, generally designated 150, forming part of the cavity 130 intermediate the first and second turbines 110 and 112, respectively. It will be appreciated that the diffuser 150 recovers kinetic energy from the fluid (steam), leaving the upstream turbine 110 prior to entry into the downstream turbine 112. To form the diffuser 150, as well as to minimize or eliminate both windage loss and spinning loss, there is provided an inner cover 152 in the form of a surface of revolution, preferably a frustoconical section having an axis coincident with the axis of rotation of the combined shafts 134 and 136. The inner cover 152 defines an inner margin of the flowpath exiting the exit annulus 147 of the upstream turbine 110 to the entrance annulus 149 of the downstream turbine 112. That is, the inner cover 152 extends from adjacent the root radius of the buckets forming the final stage of the upstream turbine 110 to the inner band of the first stage of the downstream turbine. The cover 152 is supported by the first stage diaphragm of the downstream turbine 112. The flowpath through the intermediate cavity 130 is thus substantially sealed from the coupling 138 between the shafts.

Also defining the diffuser 150 is an outer wall 154 which forms a generally axially downstream extension of the upstream turbine 110. The inner wall surface 156 of the outer wall 154 in part defines the outer margin of the flow exiting the upstream turbine 110. The inner cover 152 and wall 156 thus define an annulus about the flowpath whose area increases in a downstream direction toward the downstream turbine 112, i.e., form a diffuser. The surfaces of revolution which define the diffuser, i.e., the cover 152 and wall 156, may have any annular configuration provided the flow area increases in a downstream direction and the flowpath between the exit annulus of the upstream turbine effects a smooth flow transition therebetween.

The inlet ports 145, there being preferably two, provide for radial admission of fluid (steam) into the intermediate cavity 130. The inlet ports 145 form part of the outer shell 142 common to both the upstream and downstream turbines. The inlet ports 145 are configured to turn the generally radially inwardly directed flow as it encounters the outer wall surface 158 of the outer wall 154 and turns the flow axially and circumferentially before the flow enters the coupling cavity 130. Thus, where the inlet flowpath meets the axial flowpath from the upstream turbine, the velocity of the flow is sufficiently reduced such that mixing losses are reduced.

As a consequence of the foregoing described preferred embodiment, spinning and windage losses are substantially minimized or eliminated. Moreover, the flowpath between the exit annulus of the upstream turbine and the entry annulus of the downstream turbine effects a smooth flow transition therebetween, notwithstanding differences in heights and/or diameters of the exit and entrance annuli 147 and 149, respectively.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for coupling flowpaths of axially adjacent turbines to one another, comprising:

first and second turbine coupled axially to one another along a flowpath with fluid flow along a first flowpath portion along the first turbine exhausting from said first turbine and into a second flowpath portion along the second turbine, said turbines having respective rotors and a coupling between said first and second rotors for coupling the turbines to one another;

an inner cover extending between a final stage of said first turbine and a first stage of said second turbine and extending about and overlying the coupling between the rotors to isolate the rotor coupling from the flowpath and present a substantially smooth transition of the fluid flow from the first flowpath portion of said first turbine to the second flowpath portion of said second turbine;

an outer wall defining an outer margin of the flowpath between the first and second turbines, said inner cover and said outer wall defining a diffuser between said first and second turbines and about said coupling;

said outer wall forming part of a cast outer turbine shell.

2. Apparatus for coupling flowpaths of axially adjacent turbines to one another, comprising:

first and second turbines coupled axially to one another along a flowpath with fluid flow along a first flowpath portion along the first turbine exhausting from said first turbine and into a second flowpath portion along the second turbine, said turbines having respective rotors and a coupling between said first and second rotors for coupling the turbines to one another;

an inner cover extending between a final stage of said first turbine and a first stage of said second turbine and extending about and overlying the coupling between the rotors to isolate the rotor coupling from the flowpath and present a substantially smooth transition of the fluid flow from the first flowpath portion of said first turbine to the second flowpath portion of said second turbine;

a cavity between said first and second turbines and forming part of said flowpath, at least one fluid flow inlet for emitting fluid at a location between the first and second turbines and into said cavity;

said inlet being configured to turn the admitted fluid such that the turned fluid has a substantial circumferential flow component for joining with the fluid flow exiting the first turbine;

an outer wall defining an outer margin of the flowpath between the first and second turbines, said inner cover and said outer wall defining a diffuser between said first and second turbines and about said coupling, said outer wall forming a frustoconical section about a common rotor axis of said first and second turbines for transitioning flow between the first and second turbines.

3. Apparatus according to claim 2 wherein the first and second turbines have exit and entrance flowpath annuli, respectively, said annuli being different from one another in one of diameter and height, said cover forming a frustoconical section about a common rotor axis of said first and second turbines for transitioning fluid flow between said exit annulus and said entrance annulus.

4. Apparatus according to claim 3 wherein said entrance annulus has a larger diameter and height than the respective diameter and height of the exit annulus.

5. Apparatus according to claim 2 wherein said entrance annulus has a larger diameter than the diameter of said exit annulus.

6. Apparatus according to claim 2 wherein said inlet is configured to turn the admitted fluid such that the turned fluid has a substantial axial flow component for joining with the fluid flow exiting the first turbine.

7. Apparatus for coupling flowpaths of axially adjacent turbines to one another, comprising:

first and second turbines coupled axially to one another along a flowpath with fluid flow along a first flowpath portion along the first turbine exhausting from said first turbine through an exit annulus and into a second flowpath portion through an entry annulus to the second turbine, said turbines having respective rotors and a coupling between said first and second rotors for coupling the turbines to one another;

annular wall portions extending from adjacent the exit annulus of said first turbine and radially outwardly of the coupling between the rotors forming a diffuser for conducting the fluid flow between the exit and entrance annuli and presenting a substantially smooth transition of the fluid flow from the first flowpath portion of said first turbine to the second flowpath portion of said second turbine;

said wall portions including an inner cover extending from adjacent a root radius of turbine buckets forming a final stage of said first turbine to an inner band forming part of a first stage of said second turbine, said cover forming a surface of revolution about a common rotor axis of said first and second turbines for transitioning fluid flow between said exit annulus and said entrance annulus;

said cover overlying said coupling and is supported by said second turbine.

8. Apparatus according to claim 7 wherein the exit and entrance flowpath annuli, respectively, are different from one another in one of diameter and height, said wall portions including an outer wall forming a frustoconical section about the common rotor axis of said first and second turbines for transitioning fluid flow between said exit annulus and said entrance annulus.

9. Apparatus according to claim 8 wherein said entrance annulus has a larger diameter than a diameter of said exit annulus.

10. Apparatus according to claim 8 wherein said entrance annulus has a larger diameter and height than the respective diameter and height of the exit annulus.

11. Apparatus according to claim 8 wherein said outer wall forms part of a cast outer turbine shell.

12. Apparatus according to claim 8 including at least one fluid flow inlet for admitting fluid at a location between the first and second turbines and into a cavity therebetween.

13. Apparatus according to claim 12 wherein said inlet is configured to turn the admitted fluid such that the turned fluid has a substantial axial flow component for joining with the fluid flow exiting the first turbine.

* * * * *

UNITED STATES PATENT AND TRADEMARK OFFICE

CERTIFICATE OF CORRECTION

PATENT NO. : 6,783,321 B2
DATED : August 31, 2004
INVENTOR(S) : Lathrop et al.

It is certified that error appears in the above-identified patent and that said Letters Patent is hereby corrected as shown below:

Column 5,
Line 28, delete “turbine” and insert -- turbines --

Signed and Sealed this

Fifth Day of April, 2005

JON W. DUDAS
*Director of the United States Patent and Trademark Office*